US007267027B2

(12) United States Patent
Bertani

(10) Patent No.: US 7,267,027 B2
(45) Date of Patent: Sep. 11, 2007

(54) FAST MOUNTING HANDWHEEL WITH RETAINING RING

(75) Inventor: Alberto Bertani, Milan (IT)

(73) Assignee: Elesa S.p.A., Milan (IT)

( * ) Notice: Subject to any disclaimer, the term of this patent is extended or adjusted under 35 U.S.C. 154(b) by 156 days.

(21) Appl. No.: 10/966,128

(22) Filed: Oct. 15, 2004

(65) Prior Publication Data

US 2005/0081769 A1 Apr. 21, 2005

(30) Foreign Application Priority Data

Oct. 16, 2003 (IT) ..... MI20030483 U

(51) Int. Cl.
*G05G 1/12* (2006.01)

(52) U.S. Cl. ..... 74/553; 74/511 R; 16/441

(58) Field of Classification Search ..... 74/553, 74/543, 504, 511 R; 403/DIG. 7, 361, 309; 16/441
See application file for complete search history.

(56) References Cited

U.S. PATENT DOCUMENTS

| | | | | |
|---|---|---|---|---|
| 5,244,166 | A * | 9/1993 | Oi | 242/284 |
| 6,253,645 | B1 * | 7/2001 | Lin | 81/58.3 |
| 6,749,358 | B2 * | 6/2004 | Balsells | 403/316 |
| 2002/0146273 | A1 * | 10/2002 | Weir | 401/195 |

* cited by examiner

*Primary Examiner*—Charles A. Marmor
*Assistant Examiner*—Edwin A Young
(74) *Attorney, Agent, or Firm*—Pearne & Gordon LLP

(57) ABSTRACT

A handwheel (1) for stable, reversible engagement with an engagement end (Q) of a shaft (A) of a member to be operated. The handwheel (1) includes a stem (2) having a free end, a cavity (2A) provided in the stem (2) for cooperating with the end (Q) of the shaft (A), an elastic ring (5), and a retaining washer (6). The cavity (2A) has an open end proximate the free end of the stem (2). A first seat (3) accommodates the elastic ring (5). The first seat (3) is located proximate to the open end of the cavity (2A). A second seat (4) accommodates the retaining washer (6). The second seat (4) is located proximate to the open end of the cavity (2A).

11 Claims, 3 Drawing Sheets

FIG. 3
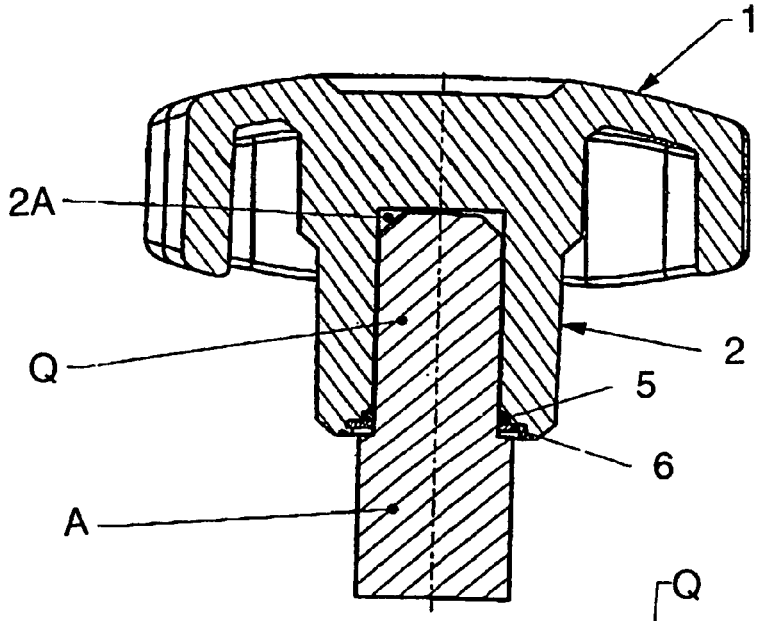
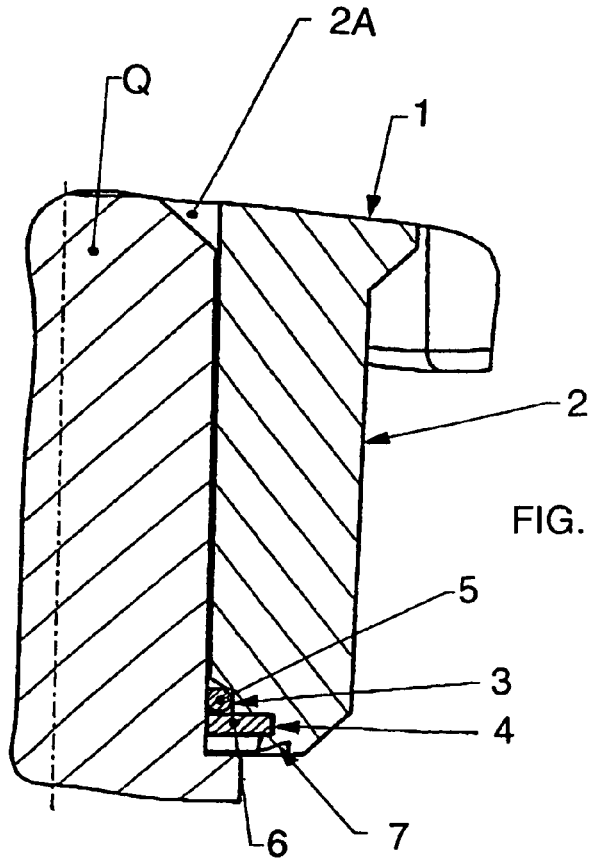
FIG. 4

FIG. 5
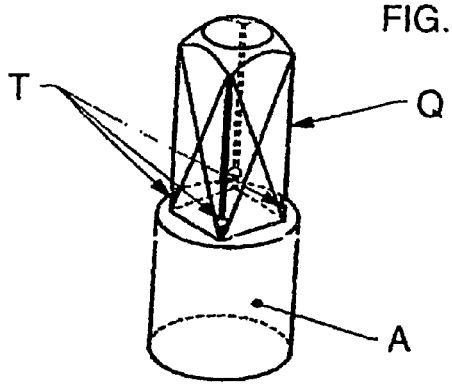
FIG. 6
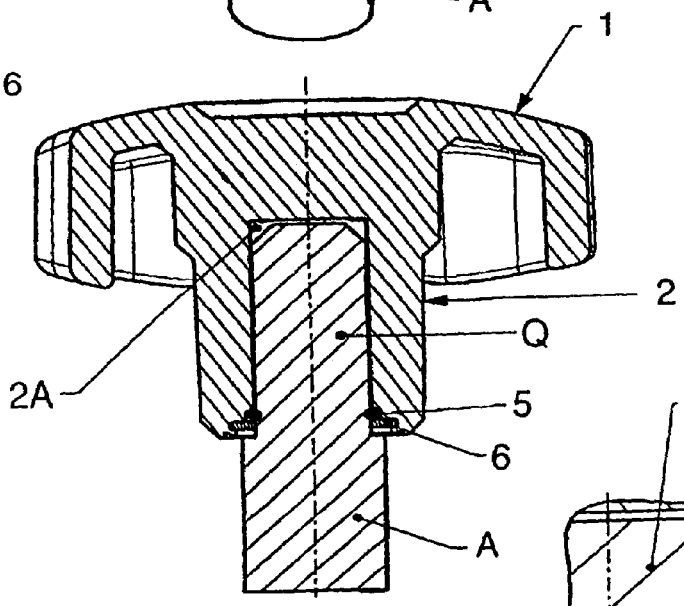
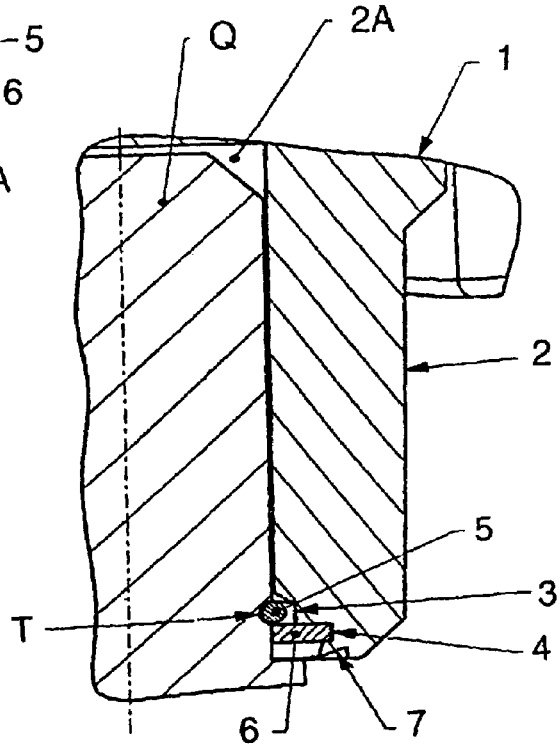
FIG. 7

FAST MOUNTING HANDWHEEL WITH RETAINING RING

BACKGROUND OF THE INVENTION

The present invention relates to a small handwheel incorporating improved means for a stable engagement of the handwheel with the end of the shaft of a member to be operated.

The mounting of small operating handwheels at the end of shafts of members to be operated, such as for example valves, shutters, taps and other similar devices is a frequent occurrence.

Such small handwheels generally have to be securely attached to the shaft of the member to be operated in order to prevent the handwheels from accidentally detaching therefrom. However, the attachment must still be easily reversible to allow access to the operated member for replacement or maintenance thereof. A screw connection at the center of the handwheel and axially aligned with shaft is commonly provided. Such a screw connection, however, is costly due to the mechanical machining required, long mounting and removal times, and the use of tools.

Such handwheels must often be removed quickly and effortlessly without using tools. For example, for safety reasons, it is often necessary to prevent unauthorized persons from operating the members after a specific adjustment has been made, which must not be changed.

BRIEF SUMMARY OF THE INVENTION

The present invention provides a handwheel for stable, reversible engagement with an engagement end of a shaft of a member to be operated. The handwheel comprises: a stem having a free end; a cavity provided in the stem for cooperating with the end of the shaft, the cavity comprising an open end proximate the free end of the stem; an elastic ring; a first seat accommodating the elastic ring, the first seat being located proximate to the open end of the cavity; a retaining washer retaining the elastic ring; and a second seat accommodating the retaining washer, the second seat being located proximate to the open end of the cavity.

BRIEF DESCRIPTION OF THE DRAWINGS

The handwheel according to the invention will now be described in further detail, purely by way of example, with reference to the accompanying drawings, which illustrate the features thereof in two different embodiments, suitable to meet different mounting and use requirements of the handwheel. In the drawings:

FIG. 3 is a cross-section of the embodiment in which the retaining of the handwheel at the square end of the shaft of a member to be operated is provided by simple friction;

FIG. 4 is a detail of the cross-section of FIG. 3 showing the engagement of the handwheel with the shaft;

FIG. 5 illustrates the square end of the shaft of a member to be operated suitably equipped, at the bottom thereof, with notches for the snap-fit retaining of the handwheel according to the invention;

FIG. 6 is a cross-section of the notches for the retaining of the handwheel of FIG. 5; and FIG. 7 is a detail of the cross-section of FIG. 3 showing the engagement of the handwheel with the shaft.

DETAILED DESCRIPTION OF THE INVENTION

Figure 1:
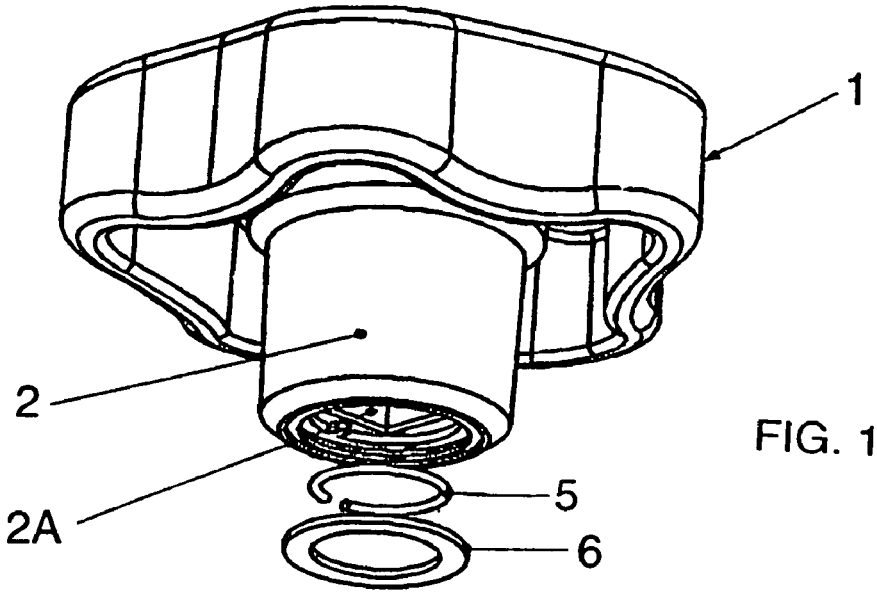
FIG. 1 is a perspective view of a handwheel according to the invention.

According to the invention, the handwheel illustrated in the drawings incorporates improved retaining means for a stable and easily reversible engagement of the handwheel with the end of the shaft of a member to be operated.

Figure 2:
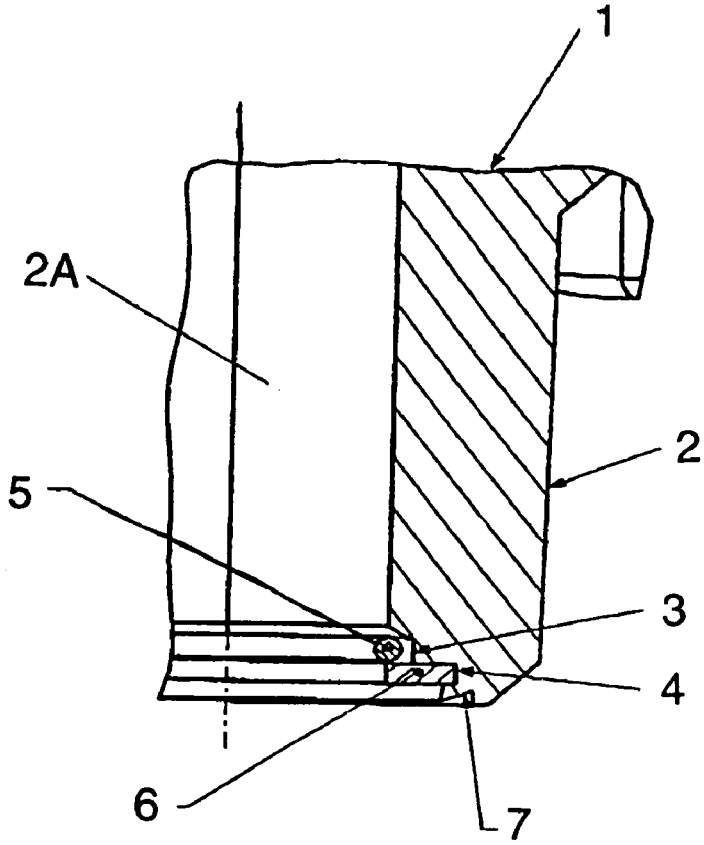
FIG. 2 shows a detail of the stem end of the handwheel.

As can be seen in FIGS. 1 and 2, the engagement cavity 2A of the stem 2 of the handwheel 1 has a non-circular section. Specifically, the engagement cavity 2A of the embodiment of FIGS. 1 and 2 has a square section, but may alternatively be polygonal, curvilinear or other non-circular shape. The engagement cavity 2A is intended to cooperate with the end Q of a shaft A having a matching section. Thus, the end Q has a square section in the embodiment of FIGS. 1 and 2.

The open end of the cavity 2A comprises two cylindrical seats 3 and 4 arranged in a step-like fashion. The seats 3, 4 accommodate a means for a stable engagement. In the present embodiment, an elastic ring 5 and a washer 6 retaining the ring serve as the means for stable engagement. In the present embodiment, the elastic ring 5 is an open, metal ring having an arcuate closed portion.

According to the present embodiment, after the ring 5 and the washer 6 have been freely inserted in the seats 3 and 4, the washer 6 is locked into the seat 4 at the outer periphery of the washer 6 by punching or otherwise deforming a portion 7 of the free end of the stem 2 of the handwheel 1. Alternatively, the washer 6 can be retained by a snap ring, such as a SEEGER ring, by replacing the washer 6 with a snap ring being force-fitted in the seat 4, or by other known locking means.

As shown in FIGS. 3 and 4, the handwheel 1 according to the invention maybe mounted onto the end Q of the shaft A of a member to be operated. The elastic ring 5 cooperates through simple friction with the edges of the end Q to hold the handwheel 1 on the shaft A. The handwheel 1 acts as a control member of the member to be operated, which is of the type intended to be operated through axial traction imparted on the handwheel 1, for example, a valve, a shutter, a tap or other such device. The engagement provided by the elastic ring 5 is sufficient to avoid an easy accidental detachment of the handwheel 1 from the shaft A, for example due to an impact or to an involuntary operation, or to the weight of the handwheel if the handwheel is arranged for example upside down. Likewise, the engagement provided by the elastic ring 6 does not prevent a direct action intended to voluntarily remove the handwheel 1 from the shaft A of the member. The handwheel 1 may therefore be removed in a simple and extremely quick manner whenever it is desired, but will otherwise remain firmly attached to the shaft A which the handwheel 1 is to control with little risk of the shaft A accidentally losing its control member.

Alternatively, as shown in FIGS. 5 to 7, the handwheel 1 according to the invention may be mounted onto the end Q of the shaft A so that the elastic ring 5 cooperates with notches T provided on the edges of the end Q of the shaft A. The notches T are formed in the proximity of the bottom of the end Q of the shaft A. In the embodiment shown in FIGS. 6 and 7, the engagement provided by the elastic ring 5 is more stable than the engagement of the embodiment of FIGS. 3 and 4, which provided by simple friction. In the present embodiment shown in FIGS. 5-7, ordinary axial traction imparted to the handwheel 1 does not cause the removal of the handwheel 1. However, removal will be possible whenever necessary, for example, when it is necessary to access the member to be operated to carry out maintenance work. Removal can be accomplished by applying a force greater than that required to remove the handwheel 1 in the embodiment of FIGS. 3 and 4.

By selecting suitable dimensions and a material having suitable elasticity for the ring 5 and by selecting a suitable size and shape of the notches T, the degree of force required to take off the handwheel 1 from the square-section end Q of the shaft A, can be set within a sufficiently wide value range, for example between 10 and 200 N, to best meet the specific use requirements of the handwheel 1.

It should be evident that this disclosure is by way of example and that various changes maybe made by adding, modifying or eliminating details without departing from the fair scope of the teaching contained in this disclosure. The invention is therefore not limited to particular details of this disclosure except to the extent that the following claims are necessarily so limited. In particular, the square section cavity 2A of the handwheel stem 2 may be replaced with any suitable cavity, for example a cavity having a triangular, hexagonal, generally polygonal, chamfered circular section, or the like, or a cavity comprising a grooved section bar to allow the cavity to accept shafts having ends with matching section and/or shape.

What is claimed is:

1. A handwheel for stable, reversible engagement with an engagement end of a shaft of a member to be operated, the shaft having an opposing end opposite the engagement end, comprising:

a stem having a free end and an operation end;

a cavity provided in the stem for cooperating with the engagement end of the shaft, the cavity comprising an open end proximate the free end of the stem and remote from the operation end of the stem, the engagement end of the shaft being received within the cavity via insertion through the open end such that the opposing end of the shaft does not extend beyond the operation end;

an elastic ring;

a first seat accommodating the elastic ring, the first seat being located proximate to the open end of the cavity;

a retaining washer retaining the elastic ring; and a second seat accommodating the retaining washer, the second seat being located proximate to the open end of the cavity.

2. The handwheel as claimed in claim 1, wherein the elastic ring comprises a disjoint metal ring.

3. The handwheel as claimed in claim 1, wherein a portion of the elastic ring is arcuate.

4. The handwheel as claimed in claim 1, wherein the retaining washer is locked into the second seat at an outer periphery of the washer by a deformed portion of the free end of the stem.

5. The handwheel as claimed in claim 1, wherein the retaining washer is a snap ring force-fitted in the second seat.

6. The handwheel as claimed in claim 1, wherein the elastic ring is provided for cooperating with edges of the engagement end of the shaft through simple friction.

7. The handwheel as claimed in claim 1, wherein the elastic ring is provided for engaging notches provided on edges of the engagement end of the shaft, the notches being proximate of a bottom of the engagement end.

8. The handwheel as claimed in claim 1, wherein the cavity comprises a square section for corresponding to a square section of the engagement end of the shaft.

9. A handwheel for stable, reversible engagement with an engagement end of a shaft of a member to be operated, comprising:

a stem having a free end and an operation end;

a cavity provided in the stem for cooperating with the engagement end of the shaft, the cavity comprising an open end proximate the free end of the stem and remote from the operation end of the stem, and a closed end proximate the operation end of the stem and remote from the free end of the stem, the engagement end of the shaft being received within the cavity via insertion through the open end;

an elastic ring;

a first seat accommodating the elastic ring, the first seat being located proximate to the open end of the cavity;

a retaining washer retaining the elastic ring; and a second seat accommodating the retaining washer, the second seat being located proximate to the open end of the cavity.

10. The handwheel as claimed in claim 9, wherein the engagement end of the shaft does not extend beyond the closed end.

11. A handwheel for stable, reversible engagement with an engagement end of a shaft of a member to be operated, comprising:

a stem having a free end and an operation end;

a hand-grip coupled to the operation end;

a cavity provided in the stem for cooperating with the engagement end of the shaft, the cavity comprising an open end proximate the free end of the stem and remote from the operation end of the stem, the engagement end of the shaft being received within the cavity via insertion through the open end such that the engagement end of the shaft does not extend beyond the hand-grip;

an elastic ring;

a first seat accommodating the elastic ring, the first seat being located proximate to the open end of the cavity;

a retaining washer retaining the elastic ring; and a second seat accommodating the retaining washer, the second seat being located proximate to the open end of the cavity.

* * * * *